US006883424B2

(12) United States Patent
Watanabe et al.

(10) Patent No.: US 6,883,424 B2
(45) Date of Patent: Apr. 26, 2005

(54) STENCIL PRINTING MACHINE AND METHOD FOR STENCIL PRINTING FOR THE SAME

(75) Inventors: Hidetoshi Watanabe, Ibaraki-ken (JP); Yoshiyuki Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/816,953

(22) Filed: Apr. 5, 2004

(65) Prior Publication Data

US 2004/0194649 A1 Oct. 7, 2004

(30) Foreign Application Priority Data

Apr. 7, 2003 (JP) ..... 2003-102945

(51) Int. Cl.[7] ..... B41L 13/00

(52) U.S. Cl. ..... 101/118; 101/128.4; 101/129; 101/484

(58) Field of Search ..... 101/118, 128.4, 101/129, 484

(56) References Cited

U.S. PATENT DOCUMENTS

2004/0154483 A1 * 8/2004 Watanabe et al.

FOREIGN PATENT DOCUMENTS

| | | |
|---|---|---|
| EP | 1 028 000 A1 | 8/2000 |
| JP | 2593623 | 6/1994 |
| JP | 8-156247 | 6/1996 |
| JP | 08-156247 | 6/1996 |

* cited by examiner

*Primary Examiner*—Charles H. Nolan, Jr.
(74) *Attorney, Agent, or Firm*—Nath & Associates PLLC; Gary M. Nath; Gregory B. Kang

(57) ABSTRACT

A machine for stencil printing includes: a control panel for setting an ink-saving printing mode; a stencil making section including a thermal print head performing an ink-saving stencil making corresponding to the ink-saving printing mode, and a thermal print head driving controller controlling the thermal print head; a printing section including a printing conditions adjustment section configured to adjust printing conditions corresponding to the ink-saving printing mode; and a control section controlling the stencil making section to perform the ink-saving stencil making corresponding to the ink-saving printing mode by the thermal print head and the thermal print head driving controller, and further controlling the printing section to control the printing conditions corresponding to the ink-saving printing mode and performs the printing processing by the printing conditions adjustment section, when the ink-saving printing mode is set up via the control panel.

18 Claims, 12 Drawing Sheets

| | STENCIL MAKING FOR STANDARD MODE | STENCIL MAKING FOR SMALL DIAMETER TYPE-A | STENCIL MAKING FOR SMALL DIAMETER TYPE-B |
|---|---|---|---|
| IMPRESSED POWER | 1.00 | 0.90 | 0.55 |
| IMPRESSION TIME | 1.00 | 1.00 | 2.00 |
| IMPRESSED ENERGY | 1.00 | 0.90 | 1.10 |
| STATES OF PERFORATED HOLES |  | | |

FIG. 13

(B4 SIZE ORIGINAL, 17.3% OF RATE OF PRINTED DOTS, 200 SHEETS OF PRINTING)

| No. | CONDITIONS FOR DRIVING THERMAL PRINT HEAD | | | CONDITIONS FOR PRINTING | | DIAMETER OF PER-FORATED HOLE | INK CONSUMP-TION | REMARKS | | |
|---|---|---|---|---|---|---|---|---|---|---|
| | IMPRESSED POWER | IMPRES-SION TIME | IMPRESSED ENERGY | PRESSURE FORCE | PRINTING SPEED | | | STENCIL MAKING | PRESSURE FORCE | PRINTING MODE |
| 1 | 1.00 | 1.00 | 1.00 | 1.00 | 1.00 | 1.00 | 1.00 | STANDARD | STANDARD | STANDARD |
| 2 | 1.00 | 1.00 | 1.00 | 0.75 | 1.00 | 1.00 | 0.94 | STANDARD | LOW | * * |
| 3 | 0.55 | 2.00 | 1.10 | 1.00 | 1.00 | 0.70 | 0.81 | SMALL DIAMETER | STANDARD | * * |
| 4 | 0.55 | 2.00 | 1.10 | 0.80 | 1.00 | 0.70 | 0.78 | SMALL DIAMETER | LOW | INK-SAVING 1 |
| 5 | 1.22 | 1.00 | 1.22 | 1.00 | 1.00 | 1.00 | 0.88 | THINNING-OUT | STANDARD | * * |
| 6 | 1.22 | 1.00 | 1.22 | 0.75 | 1.00 | 1.00 | 0.75 | THINNING-OUT | LOW | INK-SAVING 2 |

STENCIL PRINTING MACHINE AND METHOD FOR STENCIL PRINTING FOR THE SAME

BACKGROUND OF THE INVENTION

1. Field of the Invention

The present invention pertains to a stencil printing machine and a stencil printing method for the same, which performs stencil making processing and printing processing according to printing conditions, such as ink-saving printing or the like.

2. Description of the Related Art

In a stencil printing machine, which prints by pressing a printing paper against a perforated stencil sheet wrapped around a printing drum with a pressure roller, the stencil printing machine, which is possible to print under desired printing density by setting printing conditions, such as a pressure force (printing pressure force) or printing speed, is proposed by the present applicant in Japanese Patent Laid Publication No. 2593623.

According to the methodology disclosed in above publication, for example, the low cost printing to cut back ink consumption, ink-saving printing in consideration of the ecology for environment, etc. is also achieved by adjusting the printing conditions suitably so as thin printing density.

In an ink jet printing machine, methodology for reducing the number of printing dots (pixels) and cutting back ink consumption by extracting only dots relating to an appearance and an outline from image data expanded into a bit map format, forming an outline pattern, and printing only the outline pattern is disclosed in Japanese Patent Laid Open Publication (Kokai) No. H08-156247.

Although the print quality is reduced according to the ink-saving printing, the ink-saving printing is a function selected by user's own will from the viewpoint of giving priority to reduction of printing cost and the performance for environment over the printing quality. Therefore, an important subject is to provide a stencil printing machine and a method for stencil printing, which can prevent the reduction of the printing quality as much as possible and acquire more effect of the ink-saving printing.

However, if the pressure force (printing pressure force) for pressing the printing paper against the perforated stencil sheet wrapped around the printing drum with the pressure roller is reduced so as the thin printing density by using the methodology of the above-mentioned publication No. 2593623, although the reduction of the print quality is prevented, the effect of the ink-saving printing is not satisfactorily acquired.

On the other hand, if the printing dots except the outline dots is reduced by using methodology of the above-mentioned publication No. H08-156247, although the effect of the ink-saving printing is acquired up to a certain point, the printing quality is greatly reduced.

SUMMARY OF THE INVENTION

A machine for stencil printing, configured to process stencil-making by perforating a stencil sheet by a thermal print head and to process printing by pressing a printing paper against the perforated stencil sheet wrapped around a printing drum, according to an embodiment of the present invention includes: a control panel for setting an ink-saving printing mode; a stencil making section including the thermal print head configured to perform an ink-saving stencil making corresponding to the ink-saving printing mode, and a thermal print head driving controller configured to control the thermal print head; a printing section including a printing conditions adjustment section, the printing conditions adjustment section configured to adjust printing conditions corresponding to the ink-saving printing mode; and a control section controlling the stencil making section to perform the ink-saving stencil making corresponding to the ink-saving printing mode by the thermal print head and the thermal print head driving controller, and further controlling the printing section to control the printing conditions corresponding to the ink-saving printing mode and performs the printing processing by the printing conditions adjustment section, when the ink-saving printing mode is set up via the control panel.

Further, a method for stencil printing of a stencil printing machine, the stencil printing machine configured to process stencil-making by perforating a stencil sheet by a thermal print head, and to process printing by pressing a printing paper against the perforated stencil sheet wrapped around a printing drum, the stencil printing machine further including: a control panel for setting an ink-saving printing mode; a stencil making section including the thermal print head configured to perform an ink-saving stencil making corresponding to the ink-saving printing mode; and a thermal print head driving controller configured to control the thermal print head, and a printing section including a printing conditions adjustment section, the printing conditions adjustment section configured to adjust printing conditions corresponding to the ink-saving printing mode; according to an embodiment of the present invention includes: setting the ink-saving printing mode from the control panel; performing the ink-saving stencil making corresponding to the ink-saving printing mode by the thermal print head and the thermal print head driving controller; and controlling the printing conditions corresponding to the ink-saving printing mode and performs the printing processing by the printing conditions adjustment section.

BRIEF DESCRIPTION OF THE DRAWINGS

FIG. 13 shows the effects of ink-saving printing performed by the stencil printing machine according to the embodiment of the present invention.

DETAILED DESCRIPTION

Figure 1:
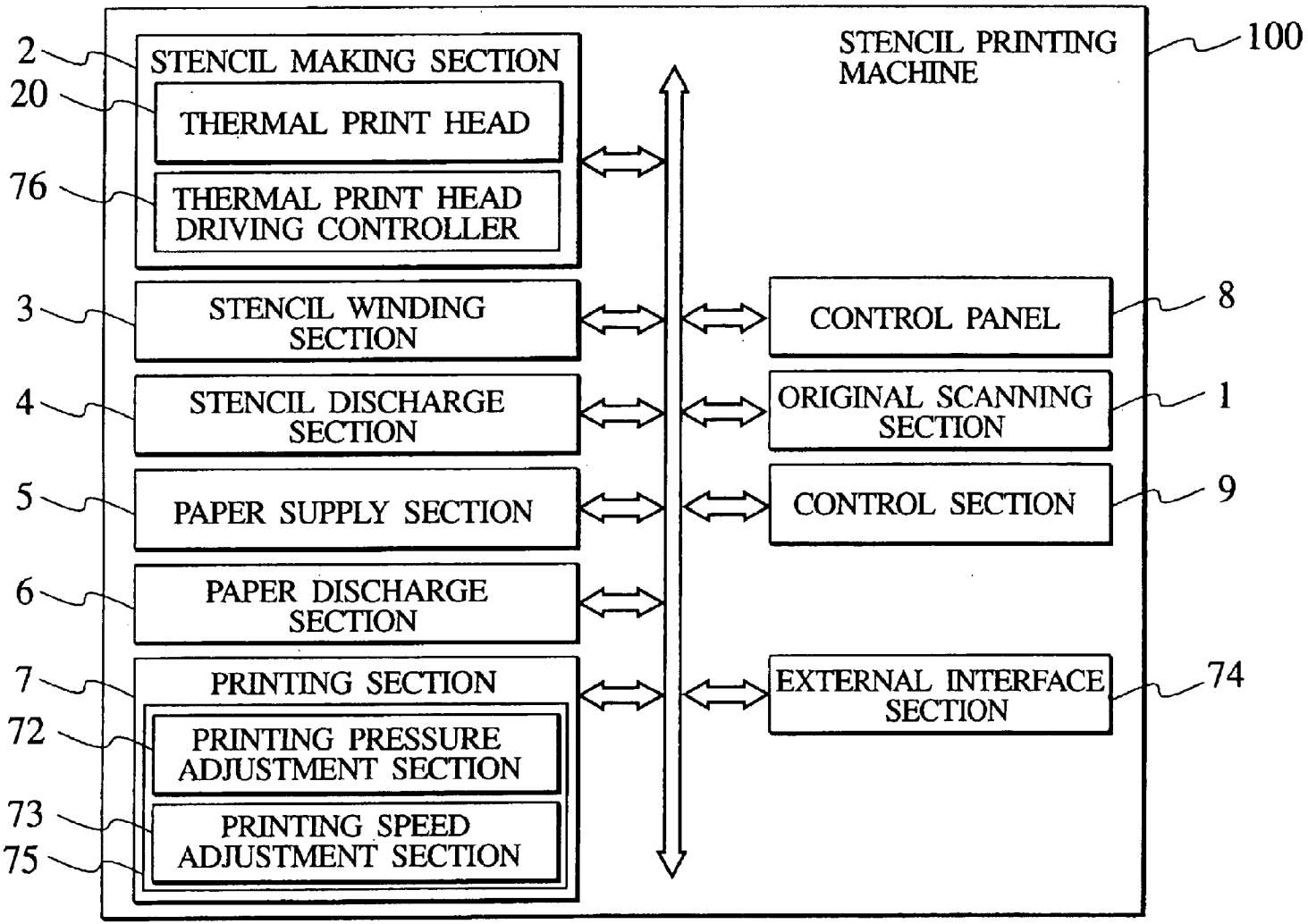
FIG. 1 is a block diagram showing an example of structure of a stencil printing machine according to an embodiment of the present invention.

The present embodiment aims to disclose a stencil printing machine and a printing method for the stencil printing machine which can prevent the reduction of printing quality as much as possible and acquire more effect of ink-saving printing.

A machine for stencil printing, configured to process stencil-making by perforating a stencil sheet by a thermal print head and to process printing by pressing a printing paper against the perforated stencil sheet wrapped around a printing drum, according to the present embodiment includes: (a) a control panel for setting an ink-saving printing mode; (b) a stencil making section including the thermal print head configured to perform an ink-saving stencil making corresponding to the ink-saving printing mode, and a thermal print head driving controller configured to control the thermal print head; (c) a printing section including a printing conditions adjustment section, the printing conditions adjustment section configured to adjust printing conditions corresponding to the ink-saving printing mode; and (d) a control section controlling the stencil making section to perform the ink-saving stencil making corresponding to the ink-saving printing mode by the thermal print head and the thermal print head driving controller, and further controlling the printing section to control the printing conditions corresponding to the ink-saving printing mode and performs the printing processing by the printing conditions adjustment section, when the ink-saving printing mode is set up via the control panel.

Further, a method for stencil printing of a stencil printing machine, the stencil printing machine configured to process stencil-making by perforating a stencil sheet by a thermal print head, and to process printing by pressing a printing paper against the perforated stencil sheet wrapped around a printing drum, the stencil printing machine further including: a control panel for setting an ink-saving printing mode; a stencil making section including the thermal print head configured to perform an ink-saving stencil making corresponding to the ink-saving printing mode; and a thermal print head driving controller configured to control the thermal print head, and a printing section including a printing conditions adjustment section, the printing conditions adjustment section configured to adjust printing conditions corresponding to the ink-saving printing mode; according to the present embodiment includes: setting the ink-saving printing mode from the control panel; performing the ink-saving stencil making corresponding to the ink-saving printing mode by the thermal print head and the thermal print head driving controller; and controlling the printing conditions corresponding to the ink-saving printing mode and performs the printing processing by the printing conditions adjustment section.

According to the above composition, at the time when the ink-saving printing mode is set up via the control panel, the thermal print head and the thermal print head driving controller performs the ink-saving stencil making suitable to the ink-saving printing mode, and the printing conditions adjustment section performs the ink-saving printing suitable to the ink-saving printing mode. Thus, by performing combining the ink-saving stencil making processing and the ink-saving printing processing, the ink-saving printing which can effectively cut back ink consumption is realized.

Further, the thermal print head driving controller controls a power impressed to the thermal print head and impression time of the power so that temperature difference between a temperature of the thermal print head and a temperature of a heat-shrinkable film of the stencil sheet becomes small, and further controls to stop the power impressed to the thermal print head at the time when the temperature of the heat-shrinkable film reaches a melting point.

According to the above composition, the thermal print head driving controller controls the power impressed to the thermal print head and an impression time of the power in order to generate heat slowly, and further controls to stop the power impressed to the thermal print head at the time when the temperature of the heat-shrinkable film of the stencil sheet reaches the melting point. Therefore the temperature difference of the thermal print head and the temperature of the heat-shrinkable film of the stencil sheet is kept smaller. As a result, although the temperature of the heat-shrinkable film exceeds the melting point, since the temperature of the heat-shrinkable film is kept low, the diameter of the perforated hole becomes also small. Further, since the heat transfer time from the thermal print head to the stencil sheet becomes longer, the temperature of the thermal print head is transferred correctly to the heat-shrinkable film, and it is therefore possible to perform the stencil making of small hole with uniform diameters.

Furthermore, since the printing conditions adjustment section adjusts a pressure force for pressing the printing paper against the perforated stencil sheet wrapped around the printing drum, as the printing conditions suitable to the ink-saving printing, it is possible to perform the ink-saving printing which can acquire more effect of the ink-saving printing without reduction of the printing quality.

Furthermore, the thermal print head driving controller performs stencil making so as non-perforation per one scanning line of the thermal print head by controlling to stop the power impressed to the thermal print head per one scanning line of the thermal print head.

According to the above composition, since the thermal print head driving controller stops the power impressed to the thermal print head per one scanning line in a sub scanning direction of the thermal print head, it is possible to achieve the stencil making for thinning-out perforation which reduces the number of the perforation so as non-perforation per one scanning line in the sub scanning direction of the thermal print head.

Moreover, the printing condition adjustment section includes a printing pressure adjustment section configured to adjust a pressure force for pressing the printing paper against the perforated stencil sheet wrapped around the printing drum, and a printing speed adjustment section configured to adjust a rotation speed of the printing drum. The printing condition adjustment section adjusts the pressure force and the rotation speed or adjusts only the pressure force, corresponding to the ink-saving printing mode and then performs the printing processing.

According to the above composition, when printing using the perforated stencil sheet by the ink-saving stencil-making, since the printing pressure adjustment section adjusts the pressure force to be suitable to the perforated stencil sheet by the ink-saving stencil-making, and the printing speed adjustment section adjusts the printing speed to be suitable to the perforated stencil sheet by the ink-saving stencil-making, it is possible to achieve the ink-saving printing which can acquire more effect of the ink-saving printing.

As explained above, according to the stencil printing machine and the stencil printing method of the present embodiment, when the ink-saving printing is set up via the control panel, the control section controlling the stencil making section to perform the ink-saving stencil making corresponding to the ink-saving printing mode by the thermal print head and the thermal print head driving controller, and further controlling the printing section to control the printing conditions corresponding to the ink-saving printing mode and performs the printing processing by the printing conditions adjustment section. Therefore it is possible to achieve the ink-saving printing which can acquire more effect of the ink-saving printing without reduction of the printing quality.

Various embodiments of the present invention will be described herein below with reference to the accompanying FIGS. 1 through 13. It is to be noted that the same or similar reference numerals are applied to the same or similar parts and elements throughout the drawings, and the description of the same or similar parts and elements will be omitted or simplified.

[Components of Stencil Printing Machine]

As shown in FIG. 1, a stencil printing machine 100 includes a control section 9, a control panel 8, an original scanning section 1, a stencil making section 2, a stencil winding section 3, a stencil discharge section 4, a paper supply section 5, a paper discharge section 6, a printing section 7, and an external interface section 74.

Although not shown, the control section 9 includes a Central Processing Unit (CPU), a Random Access Memory (RAM), a Read Only Memory (ROM), and a storage unit (for example, a hard disk drive), or the like. The CPU reads out programs and data stored in the ROM and/or the storage unit to the RAM, processes them, and controls all sections of the stencil printing machine 100 based on processing results.

The external interface section 74 includes function for the stencil printing machine 100 connecting with other apparatuses across a network etc.

Figure 3:
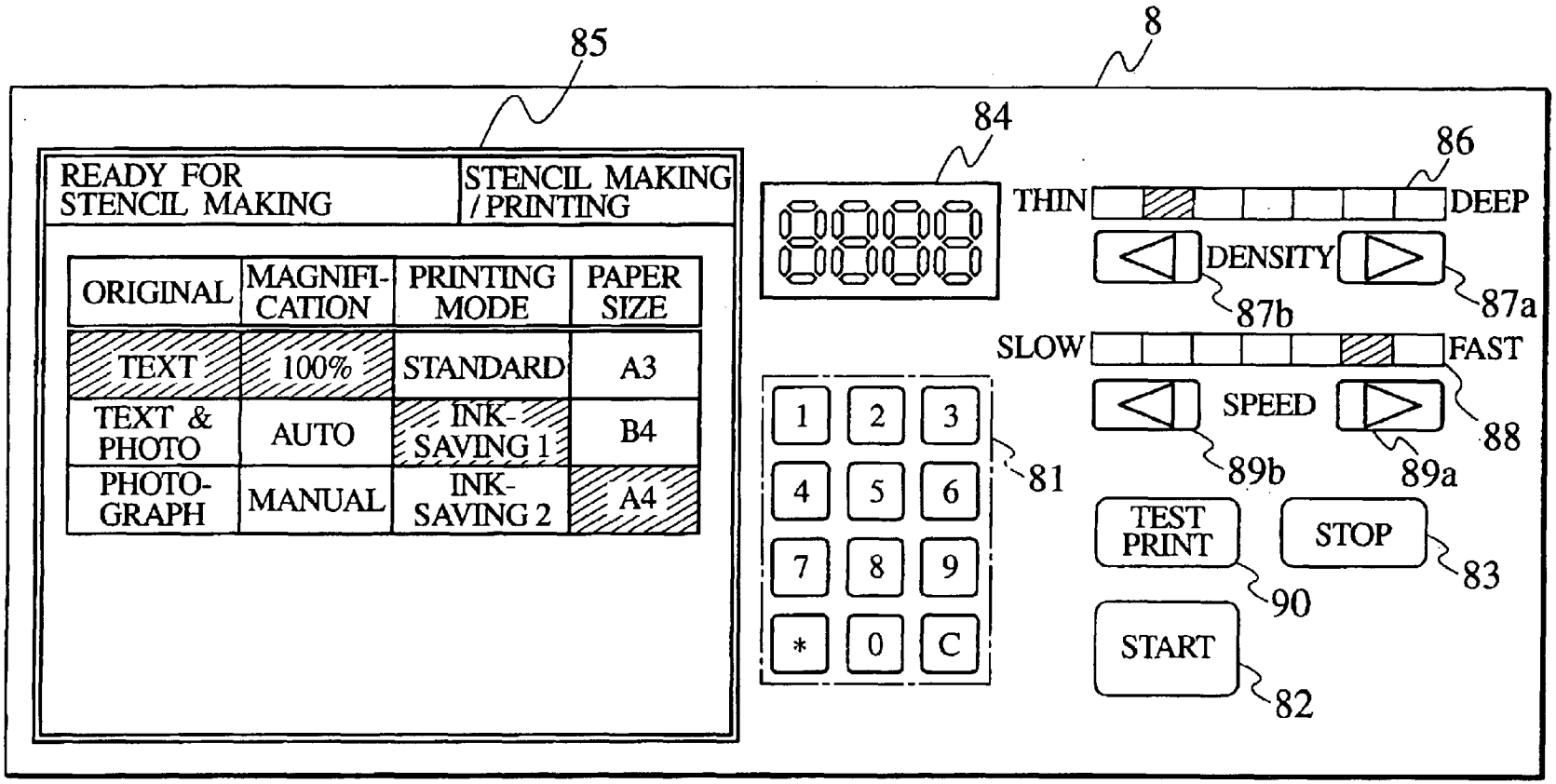
FIG. 3 is a scheme diagram showing an example of a control panel in the stencil printing machine shown in FIG. 1.

The control panel 8 is located on the upper part of the stencil printing machine 100 in order to implement an interface with a user, and has a liquid crystal touch panel 85, a ten-keypad 81, a start key 82, a stop key 83, a display section 84, and the like, as shown in FIG. 3. The liquid crystal touch panel 85 is a touch panel for setting the type of the original, printing mode, size of a printing paper or the like by the user and displaying information to the user. The ten-keypad 81 is a keypad for inputting the number of prints or the like. The start key 82 is a key for starting a stencil making processing or printing processing. The stop key 83 is a key for stopping the stencil making processing or printing processing. The display section 84 displays the set-up number of the prints or the like.

Further, the control panel 8 has printing density setting keys 87*a* and 87*b* for setting printing density, a printing density display section 86 for displaying the printing density, printing speed setting keys 89*a* and 89*b* for setting printing speed, a printing speed display section 88 for displaying the printing speed, a test print key 90 for starting a test print processing, and the like.

When performing the stencil making processing, the stencil making and printing processing will be set up in turn at the touch of a "STENCIL MAKING/PRINTING" button displayed on the upper right corner of the liquid crystal touch panel 85. For example, if the "STENCIL MAKING" processing is set up, a stencil making setting screen is displayed on the liquid crystal touch panel 85, as shown in FIG. 3. Desired stencil making conditions is set up at the touch (operation) of various selection buttons, such as "ORIGINAL"(type of the original), "MAGNIFICATION", "PRINTING MODE", and "PAPER SIZE" displayed on the stencil making setting screen, and then the stencil making processing will be started if the start key 82 is operated (touched). After the stencil making processing is completed, "READY FOR PRINTING" is displayed on the display button displayed on the upper left corner of the liquid crystal touch panel 85.

Figure 4:
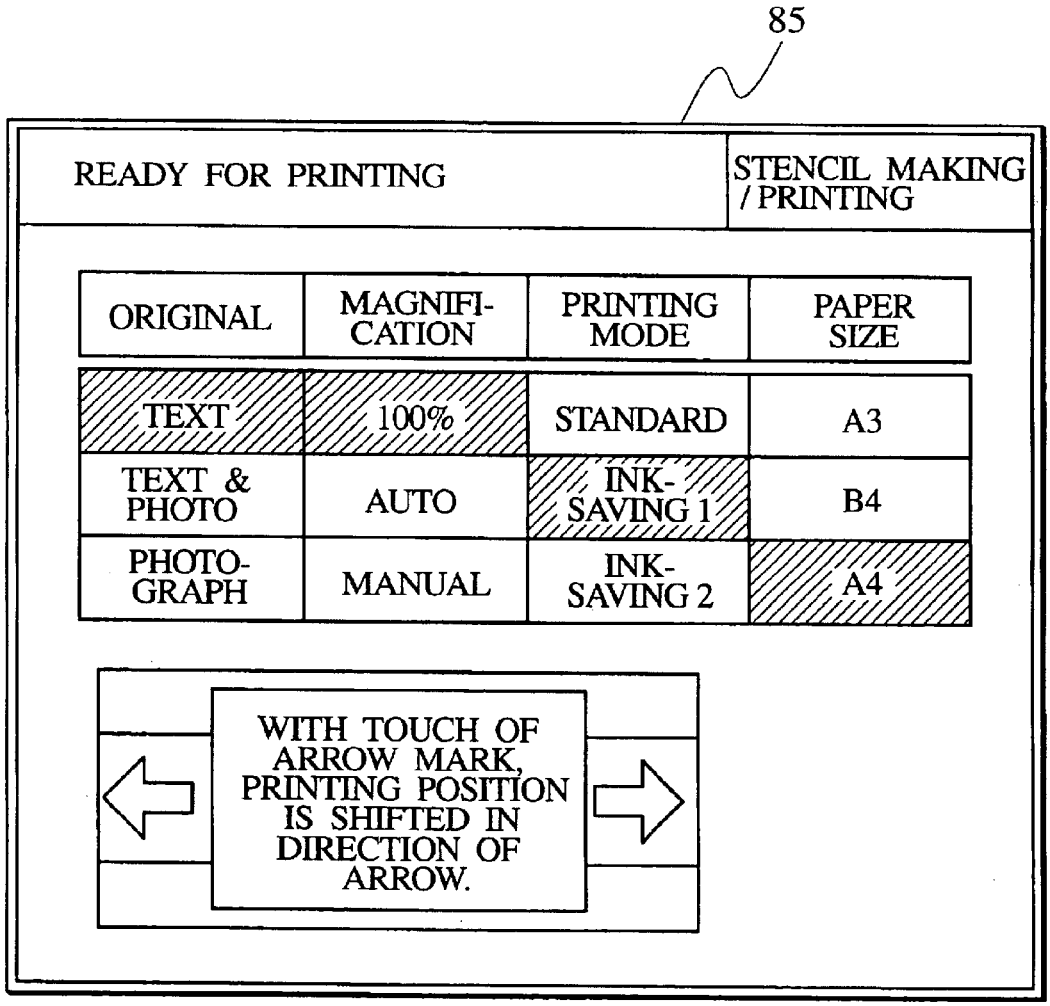
FIG. 4 is a scheme diagram showing an example of a screen of a display section of the control panel shown in FIG. 4.

Further, if the "PRINTING" processing is set up at touch of the "STENCIL MAKING/PRINTING" button, a printing setting screen as an example shown in FIG. 4 will be displayed on the liquid crystal touch panel 85. Then, desired printing conditions are set up on the printing setting screen if needed, and then the printing processing will be started if the start key 82 is operated (touched). More specifically, if the "PRINTING MODE" is set as "INK-SAVING 1" (ink-saving mode-1) or "INK-SAVING 2" (ink-saving mode-2), setting standard value of the printing density and/or the printing speed according to the "INK-SAVING 1" or "INK-SAVING 2", which have been previously set up and stored in the ROM or the like of the control section 9, will be automatically displayed on the printing density display section 86 and the printing speed display section 88. Moreover, the user is also allowed to manually operate the printing density setting keys 87*a* and 87*b* and/or the printing speed setting keys 89*a* and 89*b* in order to update the setting value.

Returning to the block diagram of FIG. 1, the stencil making section 2 includes a thermal print head 20 for perforating stencil roll sheet 18, and a thermal print head driving controller 76 for controlling the thermal print head 20 in order to achieve the stencil making processing according to the set-up printing conditions. The thermal print head driving controller 76 controls an impressed power (product of impressed voltage and impressed current, hereafter referred to as "power") impressed to the thermal print head 20 and an impression time of the power, that is an impressed energy (product of the power and the impression time, hereafter referred to as "energy"), according to the printing mode set up by the user. In addition, control data, such as a power until temperature of a heat-shrinkable film of the stencil roll sheet 18 (hereafter referred to as "heat-shrinkable film") reaches a melting point, the impression time, a period of one line (write-in period of perforating data to the thermal print head 20 per one scanning line, that is, it is the impression time of the power), or the like is set up based on a result of an experiment etc., and is stored in the ROM or the like of the control section 9

More specifically, at the time when the "PRINTING MODE" is set up as "INK-SAVING 1", the thermal print head driving controller 76 controls the impressed power and the impression time according to the control data previously stored in the ROM or the like of the control section 9, and raises temperature of the thermal print head 20 slowly. In conjunction with the temperature raise of the thermal print head 20, at the time when the temperature of the heat-shrinkable film reaches the melting point, the thermal print head driving controller 76 controls the thermal print head 20 to stop the power impressed to the thermal print head 20 according to the control data. According to these controls, although the temperature of the heat-shrinkable film exceeds the melting point, the temperature of the heat-shrinkable film is controlled at a low temperature, and the stencil making of small hole with a uniform diameter is therefore achieved.

In similarly, at the time when the "PRINTING MODE" is set up as "INK-SAVING 2", the thermal print head driving controller 76 controls to stop the heat generation of the thermal print head 20 by stopping the power per one scanning line according to the control data previously stored in the ROM or the like of the control section 9. According to this control, since the thermal print head 20 does not generate heat per one scanning line, the stencil roll sheet 18 is not perforated per one scanning line.

In other words, at the time when the "PRINTING MODE" is set up as "INK-SAVING 1" by the user, the thermal print head driving controller 76 controls the thermal print head 20 so that the number of perforation (the number of printing dots) is the same and the diameter of the perforated hole is small, as compared with the case where the "PRINTING MODE" is set up as "STANDARD". At the time when the "PRINTING MODE" is set up as "INK-SAVING 2", the thermal print head driving controller 76 controls the thermal print head 20 so that the diameter of the perforated hole is equal to and the number of perforation (the number of printing dots) is reduced per one scanning line in a sub scanning direction of the thermal print head 20, as compared with the case where the "PRINTING MODE" is set up as "STANDARD".

The printing condition adjustment section 75 includes a printing pressure adjustment section 72 for adjusting the printing density and a printing speed adjustment section 73 for adjusting the printing speed. More specifically, the printing density is adjusted such that the pressure of a pressure roller 140 against the printing drum 26 controlled by the printing pressure adjustment section 72 is adjusted to the pressure force corresponding to the printing density set up by the user. Further, the printing speed is adjusted such that the rotation speed of the printing drum 26 driven by a drum driving motor 25 controlled by the printing speed adjustment section 73 is adjusted to the printing speed (printing speed corresponding to the printing mode) set up by the user. In addition, the conversion value from the printing density to the pressure force, and the conversion value from the printing speed to the rotation speed of the printing drum 26 are previously stored in the ROM or the like of the control section 9. The printing speed adjustment section 73 controls based on the control data previously stored in the ROM or the like of the control section 9.

Furthermore, at the time when the "PRINTING MODE" is set up as "INK-SAVING 1" or "INK-SAVING 2", the pressure force is adjusted to low pressure force as compared with the standard mode, and the printing speed is adjusted to equal or fast printing speed as compared with the standard mode. In addition, the printing speed may be also fixed as printing conditions.

The pressure force data and the printing speed data are previously stored in the ROM or the like of the control section 9.

Furthermore, the user is also allowed to adjust the printing density (pressure force) and/or the printing speed to a desired setting value via the control panel 8.

As explained above, when the ink-saving printing mode is set up via the control panel 8, since the ink-saving stencil making suitable to the ink-saving printing mode and printing combining the printing conditions, such as the pressure force and/or the printing speed, suitable to the ink-saving stencil making are performed, therefore it is possible to achieve the ink-saving printing, which can acquire more effect of the ink-saving printing.

Figure 2:
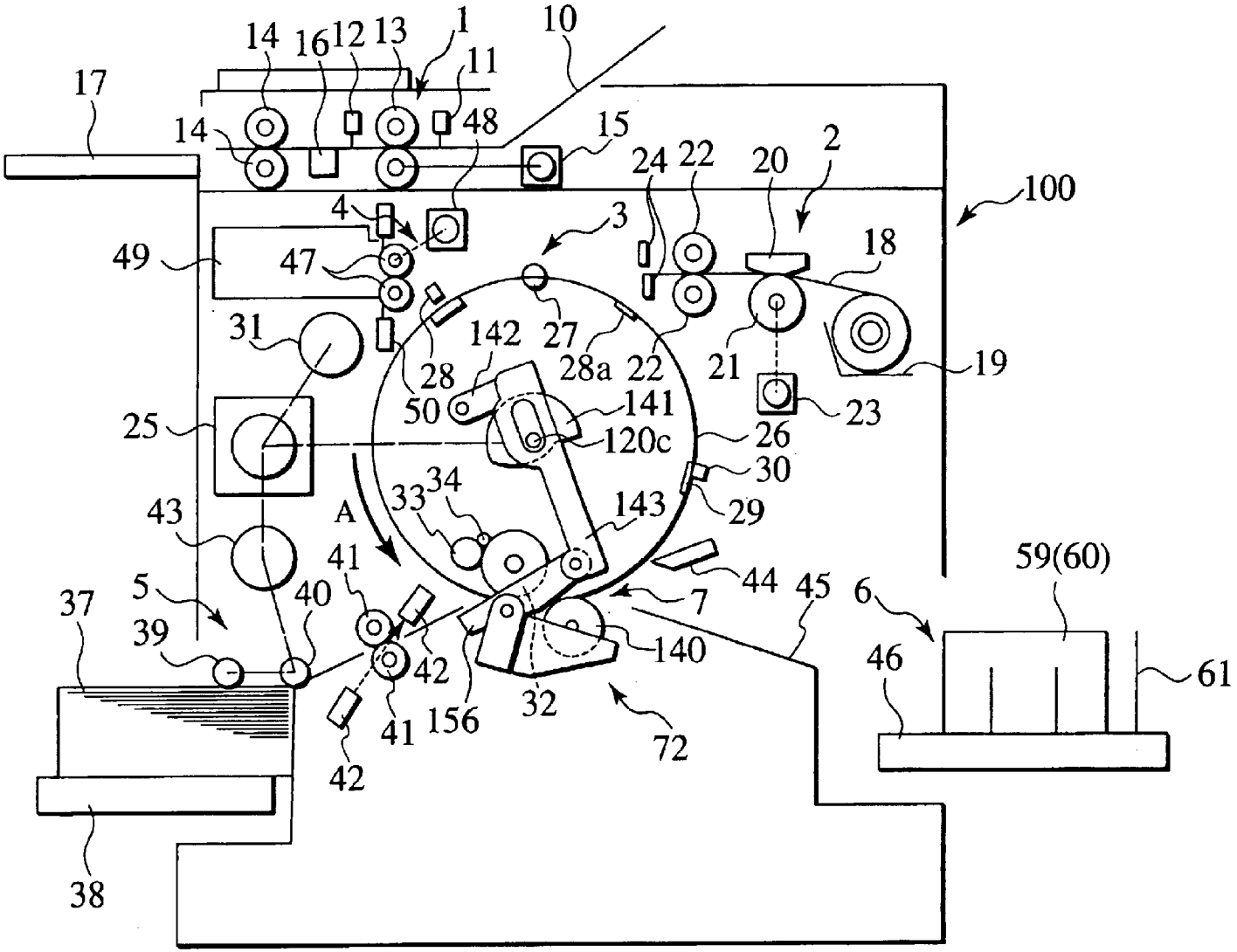
FIG. 2 is a scheme diagram showing an example of structure of a stencil making section and a printing section in the stencil printing machine shown in FIG. 1.

As shown in FIG. 2, in the stencil printing machine 100, the original scanning section 1 includes an original set tray 10, reflected-type original detection sensors 11 and 12, original feed rollers 13 and 14, a stepping motor 15, a contact-type image sensor 16, and an original discharge tray 17. An original, which is to be printed, is set on the original set tray 10. The original detection sensors 11 and 12 detect the presence or absence of the original sat on the original set tray 10. The original feed rollers 13 and 14 are rotationally driven by the stepping motor 15 and thus transfer the original sat on the original set tray 10. The image sensor 16 optically scans the image data of the original transferred by the original feed rollers 13 and 14, and changes the scanned image data into an electric signal. The original discharge tray 17 stacks the original transferred from the original set tray 10. Thus, the original stacked on the original set tray 10 is transferred by the original feed rollers 13 and 14, and the transferred original is scanned by the image sensor 16.

The stencil making section 2 includes a stencil sheet roll container 19 for containing the stencil roll sheet 18, a thermal print head 20 located downstream from the stencil sheet roll container 19, a platen roller 21 opposed to the thermal print head 20, a pair of stencil sheet feed rollers 22 located downstream from the thermal print head 20 and the platen roller 21, a write pulse motor 23 for driving the rotation of the platen roller 21 and the pair of stencil sheet feed rollers 22, and a cutter 24 located downstream from the pair of stencil sheet feed rollers 22. The stencil roll sheet 18 is transferred by rotation of the platen roller 21 and the pair of stencil sheet feed rollers 22. Then, each of heat elements of the thermal print head 20 perforates the transferred stencil roll sheet 18 selectively in order to make a stencil based on the image data scanned by the image sensor 16, and the cutter 24 cuts the perforated stencil sheet 18 to a predetermined length.

The stencil winding section 3 includes a clamp section 27, a stencil sheet sensor 28, and the like. The clamp section 27 is located on the outer peripheral surface of the printing drum 26, and clamps the leading end of the perforated stencil roll sheet 18. The stencil sheet sensor 28 detects whether the perforated stencil roll sheet 18 is wrapped around the outer peripheral surface of the printing drum 26 by referencing a detection chip 28*a* of the printing drum 26.

The printing section 7 includes the printing drum 26, a fiducial position detection sensor 30, and a rotary encoder 31. The printing drum 26 is composed of ink permeable elements at its outer peripheral surface using a porous structure, and rotated in the direction of arrow A of FIG. 2 by the drive force of the drum driving motor 25. The fiducial position detection sensor 30 detects the fiducial position of the printing drum 26 by referencing a detection chip 29 of the printing drum 26. The rotary encoder 31 detects rotation of the drum driving motor 25. The rotation position of the printing drum 26 can be detected by referencing the output pulse of the rotary encoder 31 based on the detection output of the fiducial position detection sensor 30. In addition, the drum driving motor 25 is controlled by the printing speed adjustment section 73.

Further, the printing section 7 has a squeegee roller 32 located on the inner surface of the printing drum 26, and a doctor roller 33 located on close to the squeegee roller 32. Ink 34 is accumulated in the outer peripheral space surrounded with the squeegee roller 32 and the doctor roller 33. Since the ink 34 adhering to the periphery of the rotating squeegee roller 32 passes along the crevice between the doctor rolls 33 and the squeegee roller 32, only the ink 34 of the predetermined thin film adheres to the squeegee roller 32, and the ink 34 of the predetermined thin film is supplied to the inner surface of the printing drum 26.

Furthermore, a pressure roller 140 for pressing a printing paper 37 against the printing drum 26 is driven by the printing pressure adjustment section 72, synchronizing with the rotation of the printing drum 26.

The clamp section 27 clamps the leading end of the perforated stencil sheet 18 fed from the stencil making section 2. After being clamped, the perforated stencil sheet 18 is wrapped around the outer surface of the printing drum 26 by rotating the printing drum 26. Since the pressure roller 140 presses the printing paper 37 fed from the paper supply section 5 toward to the perforated stencil sheet 18 synchronizing with the rotation of the printing drum 26, the ink 34 is transferred to the printing paper 37 through the perforation of the perforated stencil sheet 18, and the image of the original is printed on the printing paper 37.

The paper supply section 5 includes a paper feed tray 38 on which the printing paper 37 are stacked, paper feed rollers 39 and 40, a pair of timing rollers 41, and a paper detection sensor 42. The paper feed rollers 39 and 40 transfer the printing paper 37 one by one from the top of the printing paper 37 stacked on the paper feed tray 38. The pair of timing rollers 41 transfer the printing paper 37 fed by the paper feed rollers 39 and 40 to the area between the printing drum 26 and the pressure roller 140, synchronizing with the rotation of the printing drum 26. The paper detection sensor 42 detects whether or not the printing paper 37 is transferred to the space between the timing roller 41 and the timing roller 41. In addition, it is configured so that the rotation of the drum driving motor 25 is selectively transmitted to the paper feed rollers 39 and 40 via a paper feed clutch 43.

The paper discharge section 6 includes a separator 44 for separating the printing paper 37 from the printing drum 26, a paper transfer passage 45 where the printing paper 37 estranged from the printing drum 26 by the separator 44 is transferred, and a paper receiving tray 46 for stacking the printing paper 37 discharged through the paper transfer passage 45. In addition, an end fence 61 and a pair of side fences 59 and 60 are located on the paper receiving tray 46.

The stencil discharge section 4 includes a pair of stencil disposal rollers 47, a stencil disposal motor 48, a stencil disposal box 49, and a stencil removal sensor 50. The pair of stencil disposal rollers 47 transfer the used stencil sheet 18 discharged from the printing drum 26. The stencil disposal motor 48 drives the rotation of the pair of stencil disposal rollers 47. The stencil disposal box 49 contains the used stencil sheet 18 transferred by the pair of stencil disposal rollers 47. The stencil removal sensor 50 detects whether or not the used stencil sheet 18 is transferred into the stencil disposal box 49 by the pair of stencil disposal rollers 47.

[Processing Operation of Stencil Printing Machine]

Processing operation of the stencil printing machine 100 according to the present embodiment will be described with reference to the flow chart shown in FIG. 5. In addition, the processing operations to be described herein below are implemented through the control to all sections of the stencil printing machine 100 by the control section 9.

The printing processing is started at the time when the "STENCIL MAKING" is selected at the touch (operation) of "STENCIL MAKING/PRINTING" button displayed on the upper right part of the liquid crystal touch panel 85 of the control panel 8.

In Step S01, the control section 9 controls the liquid crystal touch panel 85 to display the stencil making setting screen. (The example is shown in FIG. 3.)

In Step S02, the user inputs the stencil making conditions, such as "ORIGINAL" (type of the original), "MAGNIFICATION", "PRINTING MODE", "PAPER SIZE", or the like, into the stencil making setting screen displayed on the liquid crystal touch panel 85.

In Step S03, the control section 9 controls the control panel 8 to display the stencil making conditions inputted by the user. In addition, about the printing density and the printing speed, the control section 9 reads out the standard setting value according to the printing mode from the ROM or the like of the control section 9, and displays on the control panel 8. Further, the control section 9 stores the printing conditions (the standard setting value) in the RAM or the like of the control section 9.

If the standard setting value is updated via the printing density setting keys 87*a*, 87*b* or the printing speed setting keys 89*a*, 89*b*, the control section 9 updates the setting value displayed on the control panel 8 and updates the printing conditions stored in the RAM.

In Step S04, the user sets an original on the original set tray 10, and inputs the number of prints with the ten-keypad 81.

In Step S05, the control section 9 discriminates whether the start key 82 was operated or not. As a result of the discrimination, when the start key 82 is operated, the control section 9 controls this processing to go to Step S06. On the other hand, when the start key 82 is not operated, the control section 9 waits for the start key 82 to be operated.

In Step S06, the control section 9 discriminates whether or not the original is set on the original set tray 10. As a result of the discrimination, if the original is set on the original set tray 10, the control section 9 controls this processing to go to Step S07. On the other hand, if the original is not set on the original set tray 10, the control section 9 controls this processing to go to Step S04.

In Step S07, the stencil discharge section 4 removes the used stencil sheet 18 wrapped around the printing drum 26 to be used, and discharges the used stencil sheet 18 into the stencil disposal box 49.

In Step S08, the original scanning section 1 scans an image of the original set on the original set tray 10, and sends the scanned image data to the stencil making section 2.

In Step S09, the control section 9 discriminates the inputted printing mode. As a result of the discrimination, the control section 9 controls this processing to go to Step S11 when the printing mode is set up as the "INK-SAVING 1" (ink-saving mode-1), the control section 9 controls this processing to go to Step S21 when the printing mode is set up as the "INK-SAVING 2" (ink-saving mode-2), and the control section 9 controls this processing to go to Step S31 when the printing mode is set up as the "STANDARD" (standard mode).

In Step S11, the stencil making section 2 perforates the stencil roll sheet 18 based on the image data sent from the original scanning section 1, according to the control data that was stored in the RAM or the like of the control section 9, corresponding to the "INK-SAVING 1". After that, the control section 9 controls this processing to go to Step S12. The stencil making processing for "INK-SAVING 1" will be explained in detail later.

In similarly, when the printing mode is set up as the "INK-SAVING 2", in Step S21, the stencil making section 2 perforates the stencil roll sheet 18 based on the image data sent from the original scanning section 1, according to the control data that was stored in the RAM or the like of the control section 9, corresponding to the "INK-SAVING 2". After that, the control section 9 controls this processing to go to Step S12. The stencil making processing for "INK-SAVING 2" will be explained in detail later.

Further in similarly, when the printing mode is set up as the "STANDARD", in Step S31, the stencil making section 2 perforates the stencil roll sheet 18 based on the image data sent from the original scanning section 1, according to the control data that was stored in the RAM or the like of the control section 9, corresponding to the standard mode. After that, the control section 9 controls this processing to go to Step S12.

In Step S12, the stencil winding section 3 wraps the perforated stencil roll sheet 18 around the printing drum 26.

In Step S13, after the stencil making processing is completed, the control section 9 controls the liquid crystal touch panel 85 to display the printing setting screen. (The example is shown in FIG. 4.)

In Step S14, the user inputs the printing conditions according to the printing setting screen and instructs to start the printing processing by operating the start key 82. The control section 9 discriminates whether or not the user operated the start key 82. As a result of the discrimination, when the start key 82 is operated, the control section 9 controls this processing to go to Step S15. On the other hand, when the start key 82 is not operated, the control section 9 waits for the start key 82 to be operated.

In Step S15, the control section 9 reads the control data (control data for the printing pressure adjustment section 72 and the printing speed adjustment section 73) previously stored in the ROM or the like of the control section 9, corresponding to the printing mode and the printing conditions stored in the RAM of the control section 9. The control section 9 then controls the printing pressure adjustment section 72 and the printing speed adjustment section 73.

More specifically, the printing conditions corresponding to the "INK-SAVING 1" as the printing mode are set up so that the pressure force is adjusted to low pressure force as compared with the standard mode, and the printing speed is adjusted to equal or fast printing speed as compared with the standard mode. In similarly, the printing conditions corresponding to the "INK-SAVING 2" as the printing mode are setup so that the pressure force is adjusted to equal or low pressure force as compared with the standard mode, and the printing speed is adjusted to equal or fast printing speed as compared with the standard mode.

In Step S16, the paper supply section 5 feeds one sheet of the printing paper 37 to the printing section 7.

In Step S17, the printing section 7 transfers the fed printing paper 37 so as pressing the printing paper 37 with the pressure roller 140 by the set-up pressure force against perforated the stencil sheet 18 wrapped around the printing drum 26, in order to transfers the ink 34 to the fed printing paper 37.

In Step S18, the paper discharge section 6 discharges the printing paper 37 to the paper receiving tray 46.

In Step S19, the control section 9 discriminates whether or not the printing processing of the number of the prints set up by the user ended. As a result of the discrimination, when the printing processing is not ended, the control section 9 controls this processing to return to Step S16. On the other hand, when all of the printing processing is ended, the control section 9 ends this processing.

[Stencil Making Processing for Ink-Saving]

In order to achieve the ink-saving printing according to the present invention, the stencil making processing for ink-saving suitable for the ink-saving printing is performed. The stencil making processing for ink-saving has "stencil making processing for INK-SAVING 1" corresponding to the "INK-SAVING 1" (ink-saving mode-1) as the printing mode, and "stencil making processing for INK-SAVING 2" corresponding to the "INK-SAVING 2" (ink-saving mode-2) as the printing mode. In addition, when the printing mode is the "STANDARD" (standard mode), "stencil making processing for STANDARD" is performed.

[Stencil Making Processing for Ink-Saving Mode-1]

The stencil making processing is to impressing power (voltage) to a heat generating element of the thermal print head 20 in order to generate heat, and to melting and perforating the heat-shrinkable film of the stencil roll sheet 18. However, it is difficult to perforate the stencil roll sheet 18 with a desired diameter, or to perforate (stencil-make) the stencil roll sheet 18 with uniform diameters. Moreover, it is still more difficult to logically solve a perforating mechanism. Therefore, the stencil making conditions for small diameter have been investigated by experiment, through the adjusting the power impressed to the thermal print head 20 and the impression time variously.

Figure 9:
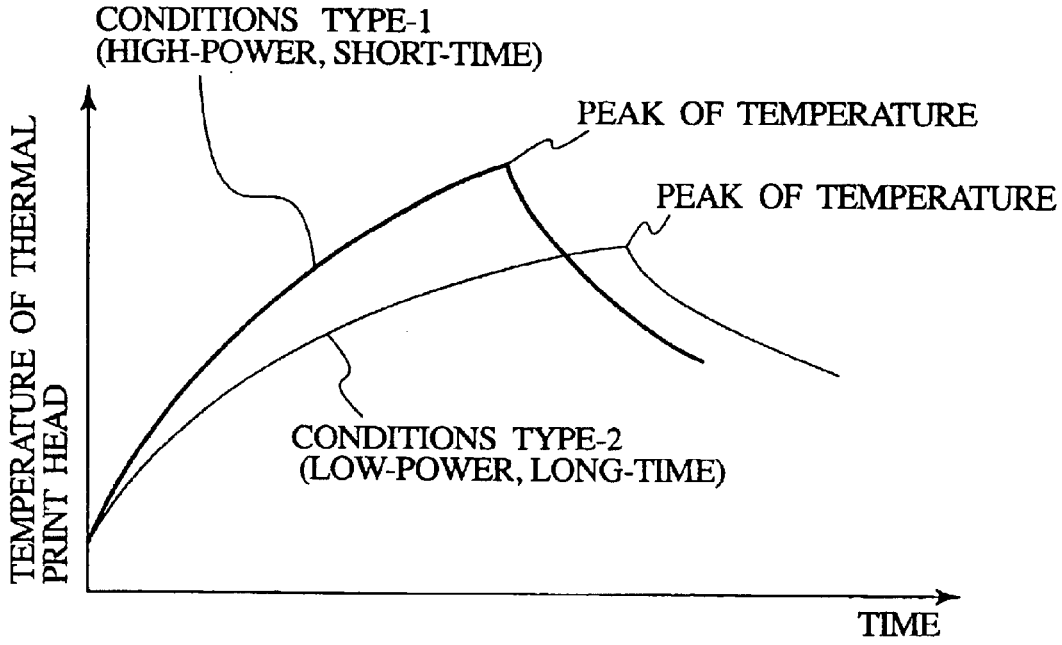
FIG. 9 shows an example of changes in temperature of the thermal print head at the time of adjusting a power impressed to the thermal print head and an impression time.

FIG. 9 shows an example of changes in temperatures of the thermal print head 20 in the case of holding the impressed energy (product of the impressed power and the impression time) as the same value and changing the impressed power and the impression time. In FIG. 9, conditions type-1 is the cases where the impressed power is adjusted to a high power and the impression time is adjusted to a short time. Further, conditions type-2 is the cases where the impressed power is adjusted to a low power and the impression time is adjusted to a long time. Because of the influence of heat dissipation characteristics of the thermal print head 20, the changes in temperatures of the conditions type-1 are steeper than the changes in temperatures of the conditions type-2, and peak temperature of the conditions type-1 is high than peak temperature of the conditions type-2.

Figure 10:
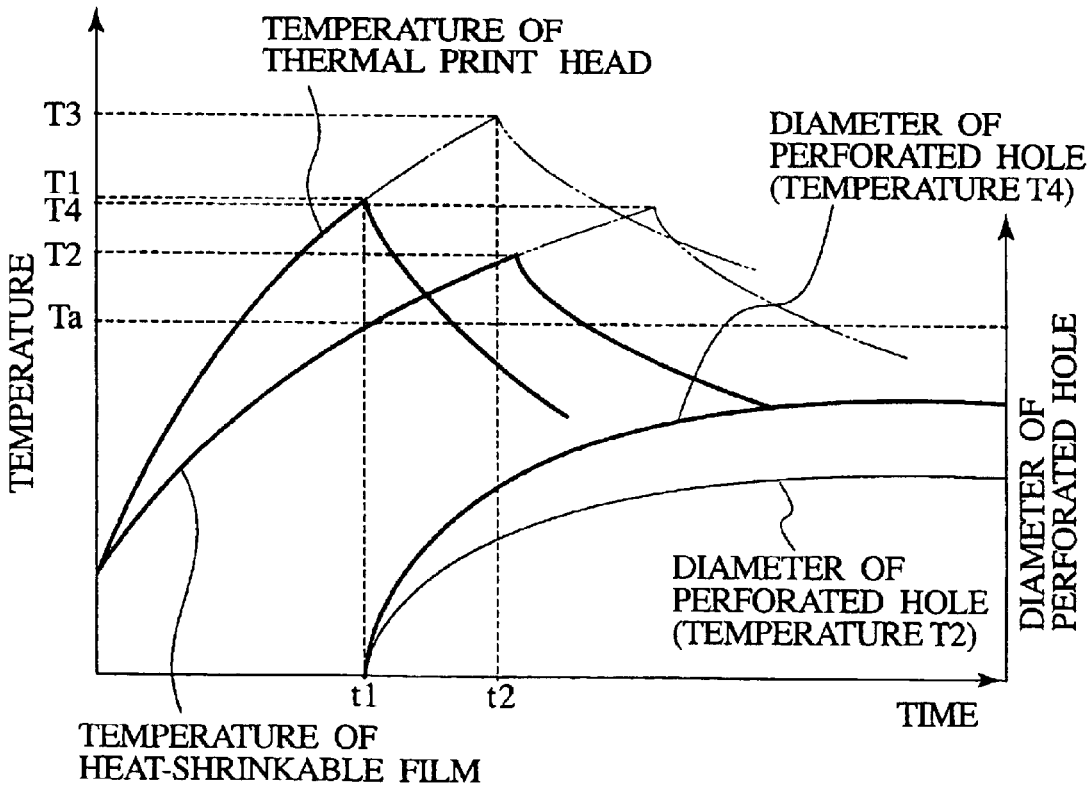
FIG. 10 shows an example of a relation between changes in the temperature of the thermal print head and a heat-shrinkable film and diameter of perforated holes.

FIG. 10 shows an example of the relation between time and changes in temperatures of the stencil roll sheet 18 in the cases where impressing fixed power to the thermal print head 20. In addition, it is assumed that the temperatures of the stencil roll sheet 18 and the temperatures of the heat-shrinkable film are the same value.

As shown in FIG. 10, when the power is impressed to the thermal print head 20, the temperatures of the thermal print head 20 increases with the passage of the impression time, and the temperatures of the heat-shrinkable film increases as the temperatures of the thermal print head 20 increases. A relation between peak temperature T1 of the thermal print head 20 and peak temperature T2 of the heat-shrinkable film is expressed as the following equation:

$$T1>T2 \quad (1)$$

On the other hand, the perforation is generated at the time when the temperature of the heat-shrinkable film reaches the melting point Ta (If "T2" satisfies (T2>Ta), the perforation is generated without exception), and if the diameter of the perforated hole expands to a specific diameter, the diameter of the perforated hole almost does not change thereafter.

Although it was shown by the experiment that the higher the peak temperature T2 of the heat-shrinkable film (that is, the peak temperature T1 of the thermal print head 20 when stopping the impressed power), the diameter of the perforated hole tends to be larger, the detailed mechanism remains unclear.

Moreover, the conditions type-1 (high impressed power and short impression time) of the temperature difference between the temperature of the thermal print head 20 and the temperature of the heat-shrinkable-film is larger than conditions type-2 (low impressed power and long impression time), and this relation always holds during impressing the power to the thermal print head 20.

As explained above, in order to perforate the small diameter:

(a) the power impressed to the thermal print head 20 and the impression time should be controlled so that the temperature difference between the temperature of the thermal print head 20 and the temperature of the heat-shrinkable film becomes small as possible; and/or (b) the power impressed to the thermal print head 20 should be stopped at the time when the temperature of the heat-shrinkable film reaches the melting point Ta.

On the other hand, the heterogeneity of the diameter of the perforated hole is considered because the temperature of the heat-shrinkable film is not reached the melting point Ta since the difference occurs in the amount of heat conducted from the thermal print head 20 to the heat-shrinkable film, because of not only the variation in the heat resistance caused by the physical characteristics of the thermal print head 20 and the unevenness of the stencil roll sheet 18, but also the variation in the generated heat caused by the common drops of the thermal print head 20 and the difference of the resistance between the heat generating elements. The results of the experiment demonstrate that the variation in the diameter of the perforated hole is converged on the predetermined range by setting up the length of the impression time of the power and the length of the period of one scanning line for a long duration. In addition, as for the impression time and impressed power until the temperature of the heat-shrinkable film reaches the melting point Ta, and as for the period of one scanning line to suppress the variation in the diameter of the perforated hole, it is preferable to calculate the optimal value through an experiment.

Figure 5:
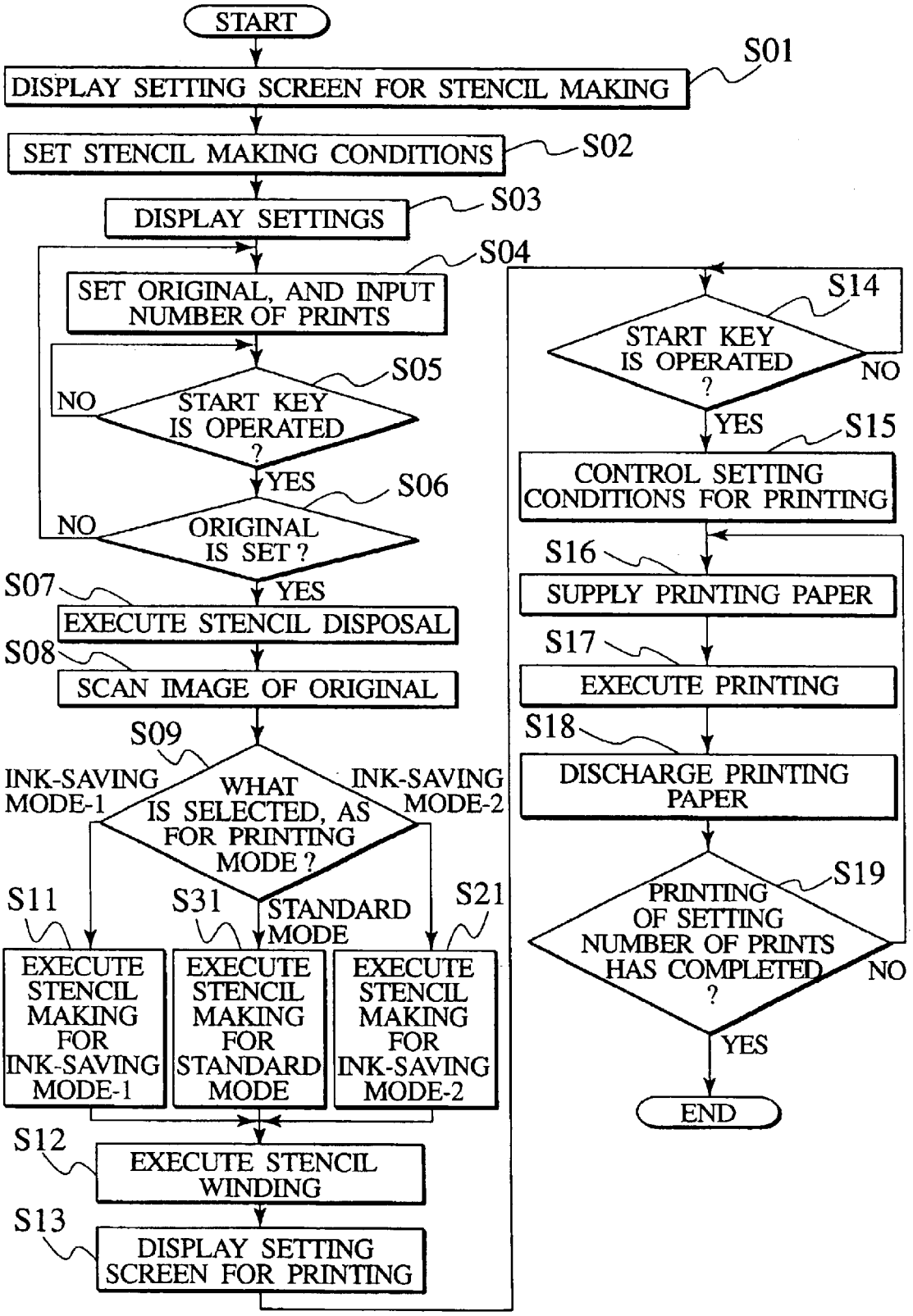
FIG. 5 is flow chart showing an example of stencil making processing and printing processing of the stencil printing machine shown in FIG. 1.

By the way, the stencil making processing for "INK-SAVING 1" in the processing of Step S11 shown in FIG. 5 is stencil making processing so that the number of perforation (the number of printing dots) is the same as compared with the stencil making processing for "STANDARD", and is stencil making processing for perforating the small diameter.

Figure 6:
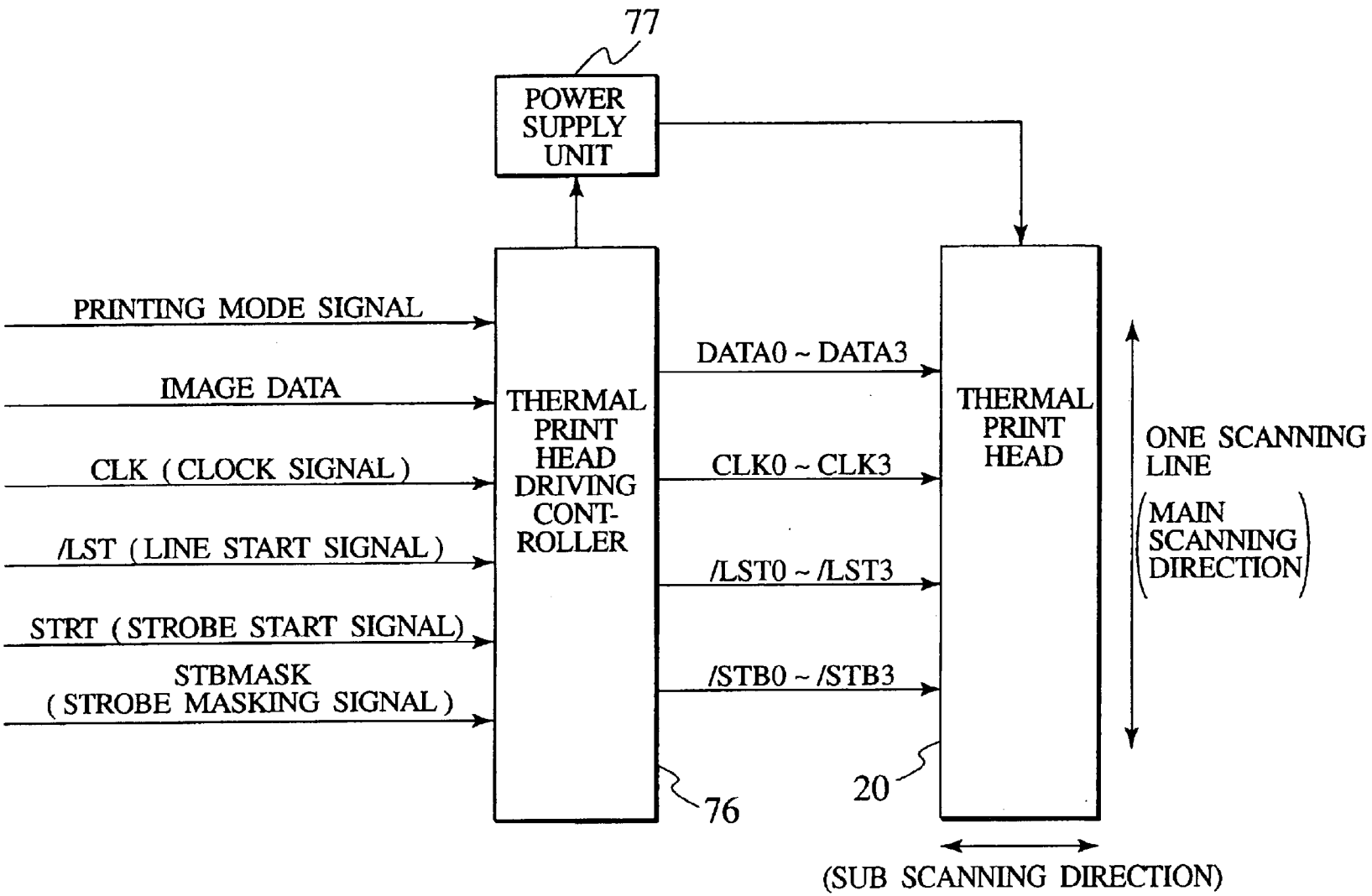
FIG. 6 is a block diagram showing an example of controlling a thermal print head by a thermal print head driving controller in the stencil printing machine shown in FIG. 1.

Therefore, since the thermal print head driving controller 76 controls the power impressed to the thermal print head 20 and impression time so as the explained above, and performs the stencil making processing for the small diameter of the perforated hole on the stencil roll sheet 18, the stencil making processing for "INK-SAVING 1" is realized As shown in FIG. 6, the thermal print head driving controller 76 will generate perforating data (DATA0, DATA1, DATA2 and DATA3), perforating clock signals (CLK0, CLK1, CLK2 and CLK3), latch signals (/LAT0, /LAT1, /LAT2 and/LAT3) and strobe signals (/STB0, /STB1, /STB2 and /STB3) which are outputted to the thermal print head 20, when image data converted to binary signals, a clock signal (CLK), a line start signal (/LST), a strobe start signal (STRT), a strobe masking signal (STBMSK) and the like are inputted. The perforating clock signals (CLK0, CLK1, CLK2 and CLK3) are signals for outputting the perforating data to the thermal print head 20. The latch signals (/LAT0, /LAT1, /LAT2 and /LAT3) are signals for converting a serial signal to a parallel signal and holding it, corresponding to the perforating data. The strobe signals (/STB0, /STB1, /STB2 and/STB3) are signals for impressing the power to the thermal print head 20.

Figure 7:
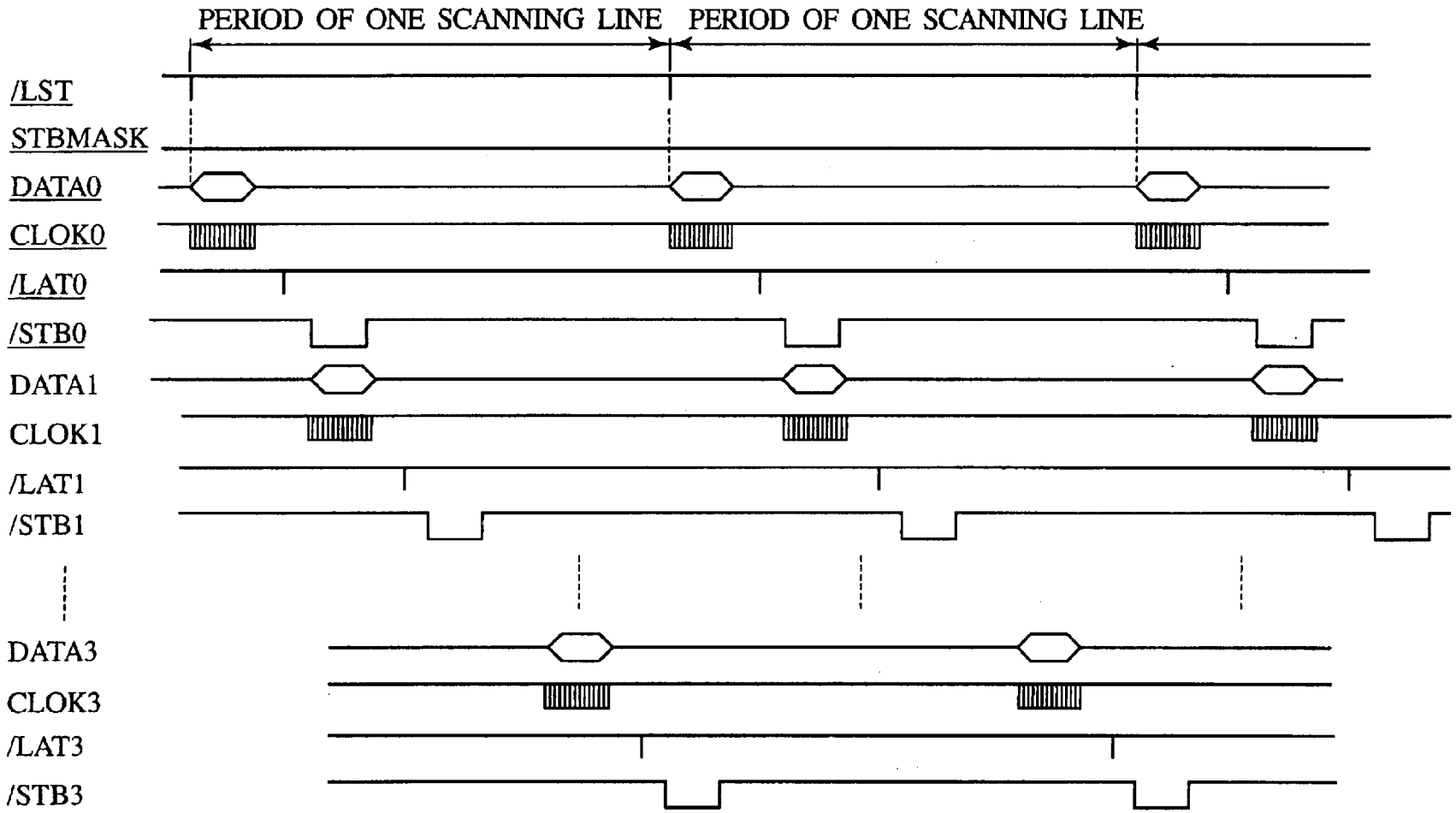
FIG. 7 is timing chart showing an example of the timing of stencil making of small hole controlled by the thermal print head driving controller shown in FIG. 6.

FIG. 7 shows timing chart for between the line start signal (/LST) and the strobe masking signal (STBMASK), and each signal outputted from the thermal print head driving controller 76. In addition, "/LST", "/LAT0", "/LAT1", "/LAT2", "/LAT3", "/STB0", "/STB1", "/STB2" and "/STB0" respectively mean negative logic.

The thermal print head 20 performs the stencil making processing, when the perforating data (DATA0, DATA1, DATA2 and DATA3), the perforating clock signals (CLK0, CLK1, CLK2 and CLK3), the latch signals (/LAT0, /LAT1, /LAT2 and /LAT3) and the strobe signals (/STB0, /STB1, /STB2 and/STB3) are inputted. In addition, the reason for dividing each input signal into four signals is for dividing the power impressed to the thermal print head 20 in order that output capacity of a power supply unit 77 becomes smaller.

The thermal print head driving controller 76 controls and drives each blocks of the thermal print head 20 divided into four by using the perforating data (DATA0, DATA1, DATA2 and DATA3), the perforating clock signals (CLK0, CLK1, CLK2 and CLK3), the latch signals (/LAT0, /LAT1, /LAT2 and /LAT3) and the strobe signals (/STB0, /STB1, /STB2 and /STB3). The perforating data (DATA0, DATA1, DATA2 and DATA3) inputted to the thermal print head 20 is inputted via serial input shift registers (not shown) installed in the thermal print head 20, and then converted to parallel data and latched into a latch circuit (not shown) by the latch signals (/LAT0, /LAT1, /LAT2 and /LAT3) generated at predetermined timing. By the logical product of the inputted strobe signals (/STB0, /STB1, /STB2 and/STB3) and the data latched to the latch circuit, the thermal print head 20 generates heat to desired timing. Therefore, it is possible to control the energy by using the strobe signals.

Furthermore, the thermal print head driving controller 76 outputs a voltage control signal for controlling a voltage impressed to the thermal print head 20 to the power supply unit 77 in response to a print mode signal sent from the control section 9, and then the power supply unit 77 impresses the voltage Vh corresponding to the print mode signal onto the thermal print head 20 in response to the voltage control signal. Therefore, it is possible to control the power by using the printing mode signal.

Figure 11:
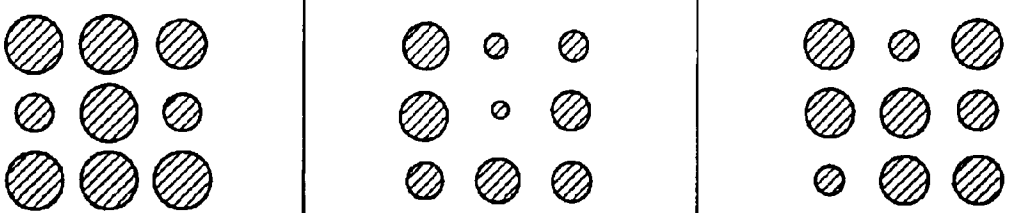
FIG. 11 is an illustration showing an example of a stencil making (perforating) result of the stencil making of small hole by adjusting a power impressed to the thermal print head and an impression time.

FIG. 11 is a schematic illustration showing perforating results of a perforating examination to search for the optimal conditions of the stencil making processing for "INK-SAVING 1" (stencil making of small diameter). FIG. 11 shows perforating results: where each of the power, the impression time, and the energy of the stencil making processing for "STANDARD" is "1"; as for the stencil making processing for small diameter type-A, the power is "0.9", the impression time is "1" and the energy is "0.9"; and as for the stencil making processing for small diameter type-B, the power is "0.55", the impression time is "2" and the energy is "1.1". As shown in FIG. 11, when the power is simply reduced so as the stencil making processing for small diameter type-A, although the diameter of perforated hole becomes small, the heterogeneity of the diameter of the perforated hole increases contrary to the reduction of the power, as compared with the stencil making processing for "STANDARD". On the other hand, when the power is reduced by one-half and the impression time is doubled so as the stencil making processing for small diameter type-B, it is possible to perforate small diameters and further to make the diameters uniform.

As explained above, it is possible to process the stencil making of small diameters and uniform size of the perforated holes and to process the ink-saving printing by controlling the power impressed to the thermal print head 20 and the impression time.

FIG. 13 shows the ink-saving effect in the case where printings of 200 sheets in using a B4 size original of which rates of printing dots is 17.3%. In FIG. 13, data of No. 1 is as a printing result of the stencil making processing for "STANDARD" by controlling to adjust the pressure force to standard value as the printing conditions, and data of No. 2 is as a printing result of the stencil making processing for "STANDARD" by controlling to adjust the pressure force to lower than standard value as the printing conditions. Further, data of No. 3 is as a printing result of the stencil making processing for "INK-SAVING 1" by controlling to adjust the pressure force to standard value as the printing conditions, and data of No. 4 is as a printing result of the stencil making processing for "INK-SAVING 1" by controlling to adjust the pressure force to lower than standard value as the printing conditions. In addition, both the printing speed of the stencil making processing for "STANDARD" and the stencil making processing for "INK-SAVING 1" are adjusted equivalent.

As shown in FIG. 13, the stencil making processing for "INK-SAVING 1" achieves more effect of the ink-saving. Furthermore, the effect of the ink-saving can be heightened more by reducing the pressure force of the pressure roller 140 as the printing conditions.

Moreover, although the stencil making processing for "INK-SAVING 1" is possible to perforate the small diameter holes as compared with the stencil making processing for "STANDARD", since the stencil making processing for "INK-SAVING 1" is the stencil making method which does not reduce the number of the printing dots, the resolution of the printing image is not reduced. Therefore, it is possible to also obtain printings almost equivalent to the stencil making processing for "STANDARD" by adjusting the pressure force to be highly when printing if needed. Thus, it is not necessary to re-produce the stencil sheet perforated by the stencil making processing for the ink-saving.

[Stencil Making Processing for Ink-Saving Mode-2]

The stencil making processing for "INK-SAVING 2" in the processing of Step S21 shown in FIG. 5 is stencil making for thinning-out perforation which perforates the holes of the diameters equivalent to the stencil making processing for "STANDARD" and reduces (thins out) the number of the perforation (number of printing dots).

The thermal print head driving controller 76 stops the heat generation of the thermal print head 20 and then reduces the number of the perforation so as non-perforation per one scanning line in the sub scanning direction of the thermal print head 20, by controlling to stop the power impressed to the thermal print head 20 per one scanning line in the sub scanning direction of the thermal print head 20.

Figure 8:
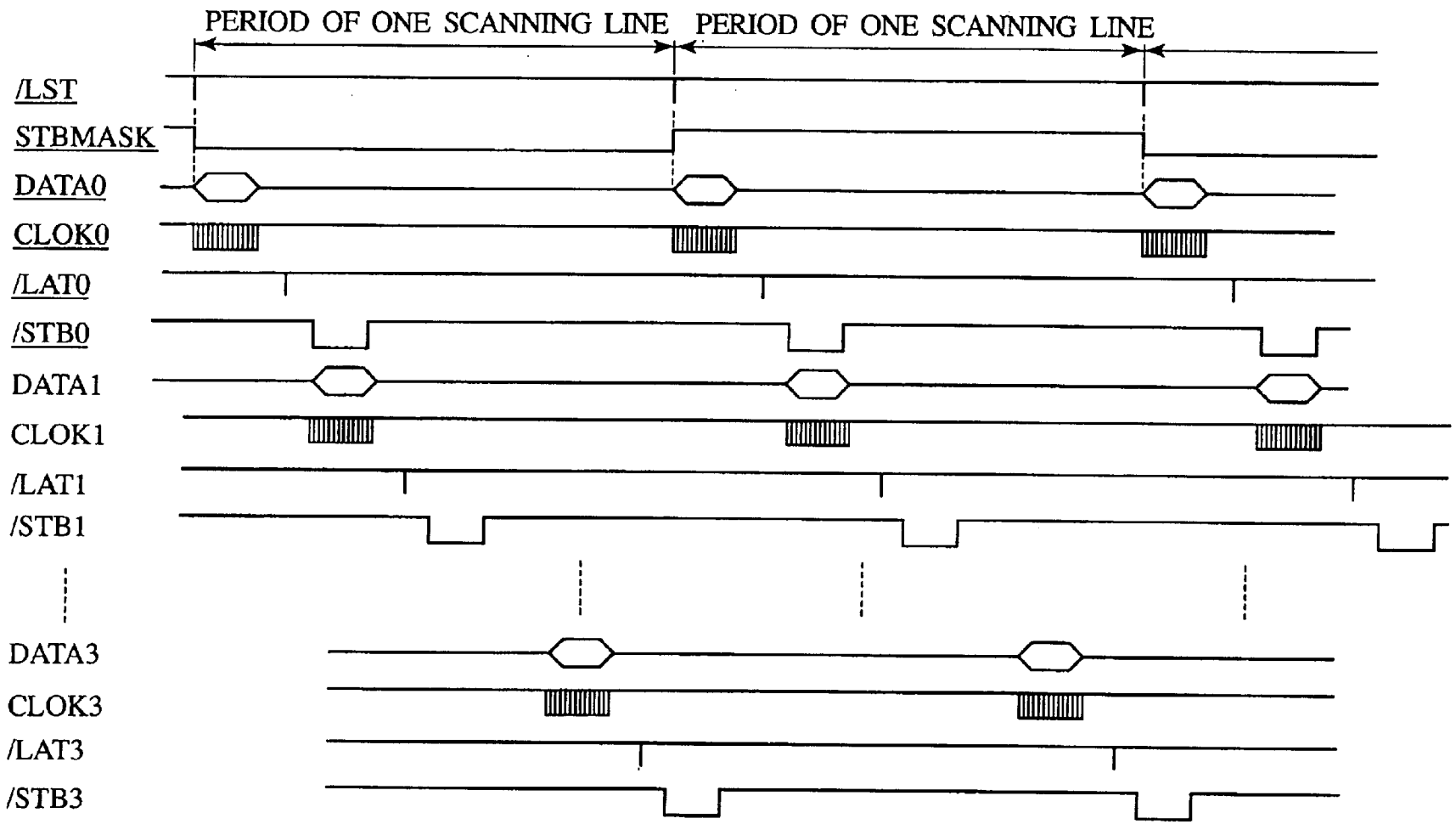
FIG. 8 is timing chart showing an example of the timing of stencil making for thinning-out perforation controlled by the thermal print head driving controller shown in FIG. 6.

FIG. 8 shows timing chart for between the line start signal (/LST) and the strobe masking signal (STBMASK), and each signal outputted from the thermal print head driving controller 76. Although each signal is generated as in the case of FIG. 7, the strobe masking signal (STBMASK) is a signal for masking (canceling) the strobe signals (/STB0, /STB1, /STB2 and /STB3). Thus, since the strobe signals (/STB0, /STB1, /STB2 and /STB3) are not be generated if the strobe masking signal (STBMASK) is inputted, the thermal print head 20 does not generate heat, and the perforation therefore can be reduced (thinned-out) per one scanning line in the sub scanning direction of the thermal print head 20.

Figure 12A:
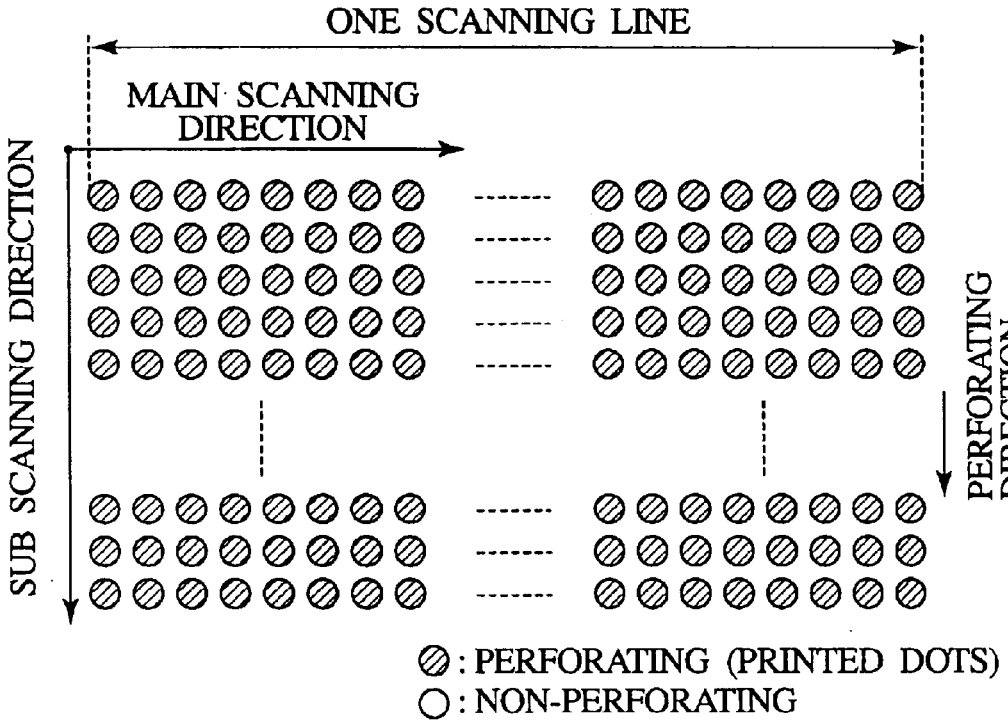
FIG. 12A is an illustration showing a (perforating) result of the stencil making without thinning-out of the perforation.
Figure 12B:
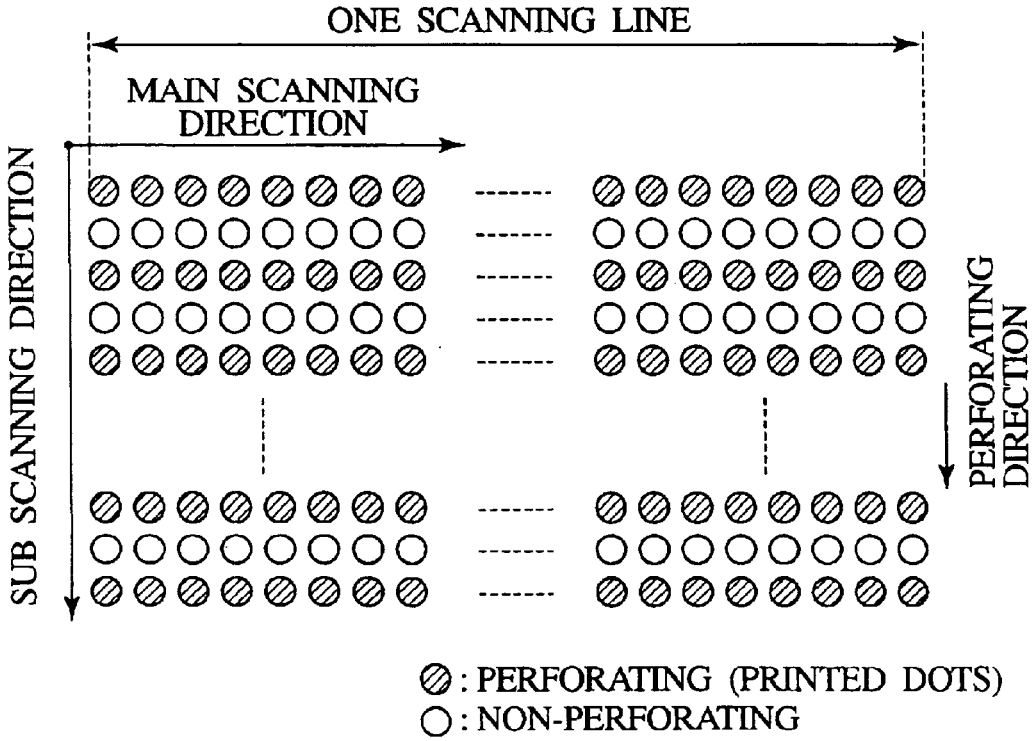
FIG. 12B is an illustration showing a (perforating) result of the stencil making for the thinning-out perforation per one scanning line.

FIG. 12A shows perforated image data schematically. FIG. 12B shows schematically a perforating result of the stencil making for the thinning-out perforation once every two scanning lines in response to the strobe masking signal (STBMASK) generated once every two scanning lines. In addition, it is possible to adjust the rate of the scanning lines to be non-perforated (rate of thinning-out) by adjusting the generation period of the strobe masking signal (STBMASK). If the rate of the thinning-out (the rate of the scanning lines to be non-perforated) is reduced, although the ink-saving effect is decrease, the printing quality more improves conversely.

In FIG. 13, data of Nos. 5 and 6 are as results of the stencil making processing for "INK-SAVING 2" (stencil making for thinning-out perforation; rate of thinning-out is 50%) as shown in FIG. 12B. The printing processing of No. 5 is a result of performing by controlling to adjust the pressure force to standard value as the printing conditions. The printing processing of No. 6 is a result of performing by controlling to adjust the pressure force to lower than standard value as the printing conditions.

As shown in FIG. 13, the stencil making processing for "INK-SAVING 2" (stencil making for thinning-out perforation) achieves more effect of the ink-saving. Furthermore, the effect of the ink-saving can be more heightened by reducing the pressure force of the pressure roller 140 as the printing conditions.

As is evident from above explanation, according to the stencil printing machine 100 of the present embodiment, when the ink-saving printing is set up via the control panel 8, the thermal print head driving controller 72 controls the power impressed to the thermal print head 20, the impression time and the energy in order to perform the ink-saving stencil making suitable to the ink-saving printing, and the printing conditions adjustment section 75 adjusts the printing conditions suitable to the ink-saving printing and then performs the printing processing. Therefore it is possible to achieve the ink-saving printing which can acquire more effect of the ink-saving printing.

The thermal print head driving controller 72 controls the power impressed to the thermal print head 20 and the impression time in order to increase the temperature of the thermal print head 20 slower than the stencil making processing for "STANDARD", and further controls to stop the power impressed to the thermal print head 20 at the time when the temperature of the heat-shrinkable film of the stencil roll sheet 18 reaches the melting point Ta. Therefore, although the temperature of the heat-shrinkable film exceeds the melting point Ta, it is possible to hold down the increasing temperature of the heat-shrinkable film, and the heat transfer time from the thermal-print head 20 to the stencil roll sheet 18 also becomes longer. Thus, it is possible to perform the stencil making of small hole with uniform diameters. By printing using the stencil roll sheet 18 perforated by the stencil making of small hole with uniform diameters, it is possible to achieve the ink-saving printing without reduction of the printing quality.

Furthermore, since the thermal print head driving controller 76 stops the power impressed to the thermal print head 20 per one scanning line in the sub scanning direction of the thermal print head 20, it is possible to achieve the stencil making for thinning-out perforation which reduces the number of the perforation so as non-perforation per one scanning line in the sub scanning direction of the thermal print head 20. Therefore, it is possible to achieve the ink-saving printing which can acquire more effect of the ink-saving printing by printing using the stencil roll sheet 18 perforated by the stencil making for thinning-out perforation.

Moreover, since the printing conditions adjustment section 75 adjusts the pressure force and/or the printing speed (rotation speed of the printing drum 26) as the printing conditions suitable to the stencil roll sheet 18 perforated in accordance with the ink-saving printing mode set-up via the control panel 8, it is possible to achieve the ink-saving printing which can acquire more effect of the ink-saving printing.

As explained above, according to the present invention, it is possible to provide the stencil printing machine and the method for the stencil printing, which can cut back the ink consumption more effectively.

Although the embodiments of the present invention have been described in detail, the present invention may be embodied in other specific forms without departing from the spirit or essential characteristics thereof.

In the present embodiment, for example, although the stencil printing machine 100 which scans the original in the original scanning section 1 and then performs the stencil making/printing processing is explained above, it is applicable similarly to a stencil printing system which connects with other apparatus, receives the original data on a network etc. via the external interface section 74, and performs stencil making/printing processing.

Furthermore, the pressure force (printing pressure) for pressing the printing paper 37 against the printing drum 26, the amount of the power impressed to the thermal print head 20, the power impression time, the energy or the like is not limited to the numerical values explained in each above-mentioned embodiment, and each case of the operation, but is the design matter which can be changed suitably.

The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

This application claims benefit of priority under 35 USC § 119 to Japanese Patent Application No. 2003-102945 filed on Apr. 7, 2003, the entire contents of which are incorporated by reference herein.

What is claimed is:

1. A machine for stencil printing, configured to process stencil-making by perforating a stencil sheet by a thermal print head and to process printing by pressing a printing paper against the perforated stencil sheet wrapped around a printing drum, the machine comprising:

a control panel for setting an ink-saving printing mode;

a stencil making section including the thermal print head configured to perform an ink-saving stencil making corresponding to the ink-saving printing mode, and a thermal print head driving controller configured to control the thermal print head;

a printing section including a printing conditions adjustment section, the printing conditions adjustment section configured to adjust printing conditions corresponding to the ink-saving printing mode; and a control section controlling the stencil making section to perform the ink-saving stencil making corresponding to the ink-saving printing mode by the thermal print head and the thermal print head driving controller, and further controlling the printing section to control the printing conditions corresponding to the ink-saving printing mode and performs the printing processing by the printing conditions adjustment section, when the ink-saving printing mode is set up via the control panel.

2. The machine of claim 1, wherein the thermal print head driving controller controls a power impressed to the thermal print head and impression time of the power so that temperature difference between a temperature of the thermal print head and a temperature of a heat-shrinkable film of the stencil sheet becomes small, and further controls to stop the power impressed to the thermal print head at the time when the temperature of the heat-shrinkable film reaches a melting point.

3. The machine of claim 1, wherein the thermal print head driving controller performs stencil making for non-perforation per one scanning line in the sub scanning direction of the thermal print head by controlling to stop the power impressed to the thermal print head per one scanning line in the sub scanning direction of the thermal print head.

4. The machine of claim 1, wherein the printing condition adjustment section includes:

a printing pressure adjustment section configured to adjust a pressure force for pressing the printing paper against the perforated stencil sheet wrapped around the printing drum; and a printing speed adjustment section configured to adjust a rotation speed of the printing drum; and wherein the printing condition adjustment section adjusts the pressure force and the rotation speed corresponding to the ink-saving printing mode and then performs the printing processing.

5. The machine of claim 2, wherein the printing condition adjustment section includes:

a printing pressure adjustment section configured to adjust a pressure force for pressing the printing paper against the perforated stencil sheet wrapped around the printing drum; and a printing speed adjustment section configured to adjust a rotation speed of the printing drum; and wherein the printing condition adjustment section adjusts the pressure force and the rotation speed corresponding to the ink-saving printing mode and then performs the printing processing.

6. The machine of claim 3, wherein the printing condition adjustment section includes:

a printing pressure adjustment section configured to adjust a pressure force for pressing the printing paper against the perforated stencil sheet wrapped around the printing drum; and a printing speed adjustment section configured to adjust a rotation speed of the printing drum; and wherein the printing condition adjustment section adjusts the pressure force and the rotation speed corresponding to the ink-saving printing mode and then performs the printing processing.

7. The machine of claim 1, wherein the printing condition adjustment section includes a printing pressure adjustment section configured to adjust a pressure force for pressing the printing paper against the perforated stencil sheet wrapped around the printing drum, and wherein the printing condition adjustment section adjusts only the pressure force corresponding to the ink-saving printing mode and then performs the printing processing.

8. The machine of claim 2, wherein the printing condition adjustment section includes a printing pressure adjustment section configured to adjust a pressure force for pressing the printing paper against the perforated stencil sheet wrapped around the printing drum, and wherein the printing condition adjustment section adjusts only the pressure force corresponding to the ink-saving printing mode and then performs the printing processing.

9. The machine of claim 3, wherein the printing condition adjustment section includes a printing pressure adjustment section configured to adjust a pressure force for pressing the printing paper against the perforated stencil sheet wrapped around the printing drum, and wherein the printing condition adjustment section adjusts only the pressure force corresponding to the ink-saving printing mode and then performs the printing processing.

10. A method for stencil printing of a stencil printing machine, the stencil printing machine configured to process stencil-making by perforating a stencil sheet by a thermal print head, and to process printing by pressing a printing paper against the perforated stencil sheet wrapped around a printing drum, the stencil printing machine further including: a control panel for setting an ink-saving printing mode; a stencil making section including the thermal print head configured to perform an ink-saving stencil making corresponding to the ink-saving printing mode; and a thermal print head driving controller configured to control the thermal print head, and a printing section including a printing conditions adjustment section, the printing conditions adjustment section configured to adjust printing conditions corresponding to the ink-saving printing mode; the method comprising:

setting the ink-saving printing mode from the control panel;

performing the ink-saving stencil making corresponding to the ink-saving printing mode by the thermal print head and the thermal print head driving controller; and controlling the printing conditions corresponding to the ink-saving printing mode and performs the printing processing by the printing conditions adjustment section.

11. The method of claim 10, wherein a power impressed to the thermal print head and impression time of the power are controlled so that temperature difference between a temperature of the thermal print head and a temperature of a heat-shrinkable film of the stencil sheet becomes small, and the power impressed to the thermal print head is further controlled to stop at the time when the temperature of the heat-shrinkable film reaches a melting point.

12. The method of claim 10, wherein stencil making for non-perforation is performed per one scanning line in the sub scanning direction of the thermal print head by controlling to stop the power impressed to the thermal print head per one scanning line in the sub scanning direction of the thermal print head.

13. The method of claim 10, wherein the printing condition adjustment section includes: a printing pressure adjustment section configured to adjust a pressure force for pressing the printing paper against the perforated stencil sheet wrapped around the printing drum; and a printing speed adjustment section configured to adjust a rotation speed of the printing drum; and wherein in the controlling the printing conditions, the pressure force and the rotation speed are adjusted corresponding to the ink-saving printing mode.

14. The method of claim 11, wherein the printing condition adjustment section includes: a printing pressure adjustment section configured to adjust a pressure force for pressing the printing paper against the perforated stencil sheet wrapped around the printing drum; and a printing speed adjustment section configured to adjust a rotation speed of the printing drum; and wherein in the controlling the printing conditions, the pressure force and the rotation speed are adjusted corresponding to the ink-saving printing mode.

15. The method of claim 12, wherein the printing condition adjustment section includes: a printing pressure adjustment section configured to adjust a pressure force for pressing the printing paper against the perforated stencil sheet wrapped around the printing drum; and a printing speed adjustment section configured to adjust a rotation speed of the printing drum; and wherein in the controlling the printing conditions, the pressure force and the rotation speed are adjusted corresponding to the ink-saving printing mode.

16. The method of claim 10, wherein the printing condition adjustment section includes a printing pressure adjustment section configured to adjust a pressure force for pressing the printing paper against the perforated stencil sheet wrapped around the printing drum, and wherein in the controlling the printing conditions, only the pressure force is adjusted corresponding to the ink-saving printing mode.

17. The method of claim 11, wherein the printing condition adjustment section includes a printing pressure adjustment section configured to adjust a pressure force for pressing the printing paper against the perforated stencil sheet wrapped around the printing drum, and wherein in the controlling the printing conditions, only the pressure force is adjusted corresponding to the ink-saving printing mode.

18. The method of claim 12, wherein the printing condition adjustment section includes a printing pressure adjustment section configured to adjust a pressure force for pressing the printing paper against the perforated stencil sheet wrapped around the printing drum, and wherein in the controlling the printing conditions, only the pressure force is adjusted corresponding to the ink-saving printing mode.

* * * * *